United States Patent [19]

Härle et al.

[11] Patent Number: 4,759,253

[45] Date of Patent: Jul. 26, 1988

[54] METRONOME

[75] Inventors: Fritz Härle, Isny; Georg Vochezer, Argenbühl; Erhard Schmid, Isny, all of Fed. Rep. of Germany

[73] Assignee: Rudolf Wittner GmbH u. Co., Fed. Rep. of Germany

[21] Appl. No.: 79,644

[22] Filed: Jul. 30, 1987

[30] Foreign Application Priority Data

Aug. 22, 1986 [DE] Fed. Rep. of Germany ..... 3628515

[51] Int. Cl.[4] ..... G10B 15/00

[52] U.S. Cl. ..... 84/484

[58] Field of Search ..... 84/484; 368/254, 269–273

[56] References Cited

U.S. PATENT DOCUMENTS

| | | | |
|---|---|---|---|
| 734,032 | 7/1903 | Adams | 84/484 |
| 738,093 | 9/1903 | Brady | 84/484 |
| 3,590,524 | 7/1971 | Wittner | 84/484 |

FOREIGN PATENT DOCUMENTS 1810596 11/1968 Fed. Rep. of Germany .

*Primary Examiner*—L. T. Hix
*Assistant Examiner*—Brian W. Brown
*Attorney, Agent, or Firm*—Kramer, Brufsky & Cifelli

[57] ABSTRACT

In a metronome, a toothed wheel and a bell drum each comprise toothings facing each other, by means of which the toothed wheel and the bell drum are in positive engagement with each other in defined angular positions. The toothed wheel and the bell drum are axially displaceable relative to each other on the toothed wheel shaft in order to release their positive engagement and to alter their angular position. When the metronome is in operation, the toothed wheel and the bell drum are kept in mutual positive engagement by releasable holding means.

9 Claims, 3 Drawing Sheets

METRONOME

The invention relates to a metronome comprising a pendulum which is fixedly mounted on a pendulum shaft for rotation therewith; a toothed wheel shaft which is driven by a windable spring mechanism; a toothed wheel which is fixedly arranged on the toothed wheel shaft for rotation therewith and drives the pendulum by means of an anchor which is fixedly mounted on the pendulum shaft for rotation therewith; a bell which is struck by a bell striker; and a bell drum which is rotatably mounted on the toothed wheel shaft and is normally fixedly connected to the toothed wheel for rotation therewith, to actuate the bell striker.

In such a metronome, the pendulum periodically emits audible rhythmic beats. Depending on the set rhythm (for example, $\frac{3}{4}$ or 4/4 rhythm) the bell is made to sound by the bell striker at the first beat only of the selected rhythm (for example, at each third or fourth rhythmic beat of the selected rhythm by the user of the metronome. Therefore, precise synchronization of the sounding of the bell with the pertinent rhythmic beat is important.

In a known metronome of the generic kind mentioned at the beginning (German Pat. No. 1,810,596, FIGS. 1 and 2) the toothed wheel and a bell drum comprised of four single gears are pressed together by a nut to thereby enable rotation with one another. When toothed wheel and bell drum are to be adjusted relative to each other in order to synchronize the rhythmic beat with the stroke of the bell, the nut must first be slackened and then retightened after the adjustment has been made. Relative adjustment between toothed wheel and bell drum is carried out in an infinitely variable manner by trained staff.

In the known metronome, manufacture, assembly and adjustment of toothed wheel and bell drum involve considerable effort and are time-consuming and difficult. Infinitely variable adjustability of the bell drum relative to the toothed wheel may result in inaccuracies and does not enable the above-mentioned synchronization of bell stroke and rhythmic beat to be carried out in a simple manner.

The object of the invention is to provide in a generic metronome a simple arrangement for synchronization of bell drum and toothed wheel and to enable better checking of the synchronization.

In accordance with the invention, the object is achieved by the following features:

a. the toothed wheel and the bell drum each comprise toothings facing each other, by means of which the toothed wheel and the bell drum are in positive engagement with each other in defined angular positions;

b. the toothed wheel and the bell drum are axially displaceable relative to each other on the toothed wheel shaft in order to release their mutual positive engagement and to alter their angular positions;

c. the toothed wheel and the bell drum are kept in mutual positive engagement by releasable holding means.

The following description of preferred embodiments serves in conjunction with the appended drawings to explain the invention in further detail. In the drawings.

Figure 1:
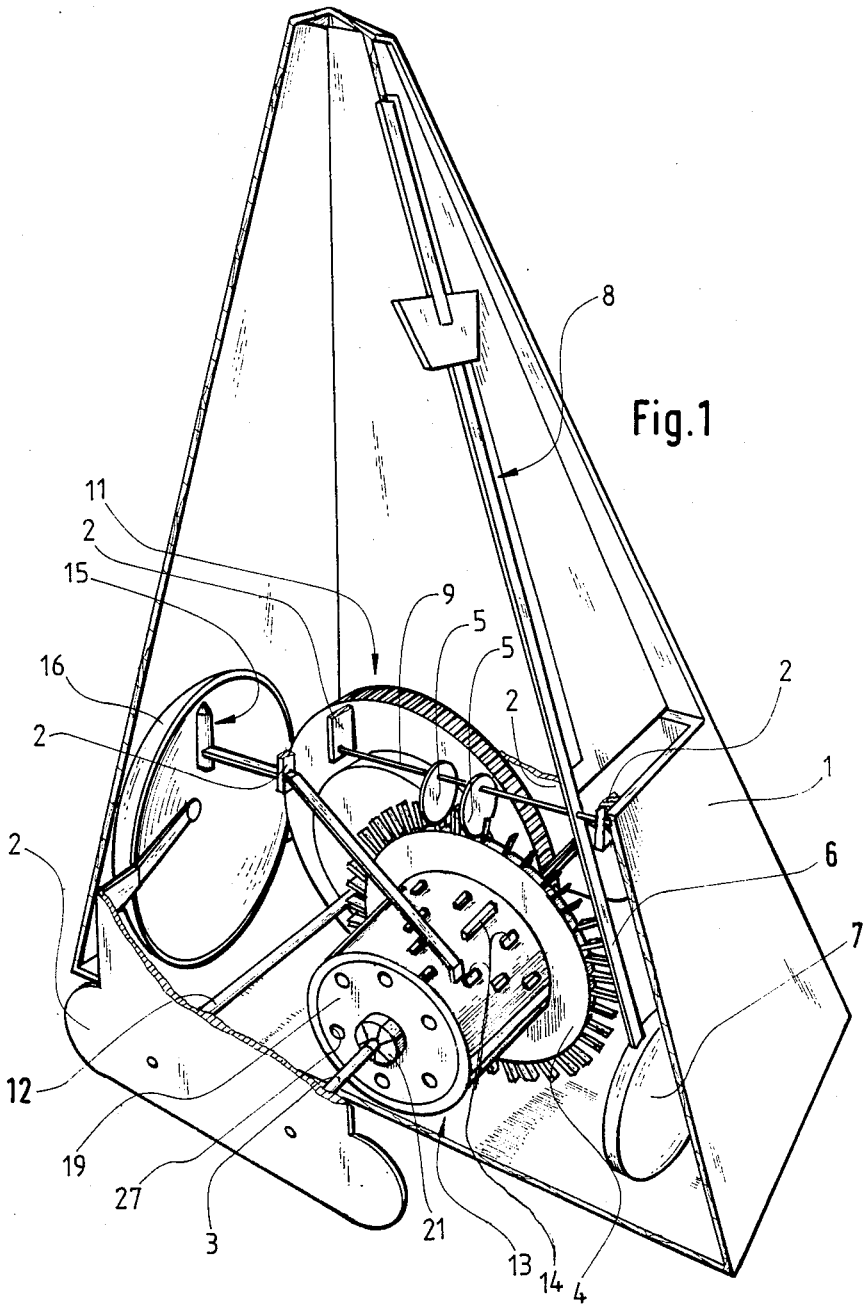
FIG. 1 is a sectional schematic view of a metronome comprising pendulum, bell, toothed wheel and bell drum.

The metronome illustrated in FIG. 1 comprises in the conventional manner a pyramidal casing 1 made, for example, of wood. A frame 2 fixedly arranged in the interior of casing 1 serves as bearing for the individual parts of the metronome works.

A toothed wheel 4 is fixedly arranged on a toothed wheel shaft 3 for rotation therewith. The toothed wheel shaft 3 is mounted for rotation in frame 2. A pendulum 8 comprising pendulum rod 6 and pendulum wieght 7 is driven in a known manner by the toothed wheel by means of an anchor 5. Pendulum rod 6 and anchor 5 are fixedly arranged on a pendulum shaft 9 for rotation therewith. The pendulum shaft 9 is likewise rotatably mounted in frame 2. The toothed wheel shaft 3 is driven in a manner likewise known per se by a windable clockwork or spring mechanism 11 whose shaft is designated by reference numeral 12 in FIG. 1.

Also arranged on the toothed wheel shaft 3 is a bell drum 13 which is fixedly connected with toothed wheel 4 for rotation therewith. Cams 14 protrude from the bell drum at specififed angular spacings. The cams cooperate in a known manner with a bell striker 15 mounted for swivel motion in frame 2 in such a way that when a cam 14 passes the free end of the bell striker, the striker head provided on the other end always strikes a bell 16 mounted on frame 2. Bell striker 15 and bell 16 are displaceable in the axial direction of toothed wheel shaft 3 (in a known and, therefore, not illustrated manner). Hence, depending on the desired rhythm, bell striker 15 is actuated by a specific ring of cams on bell drum 13.

Figure 2:
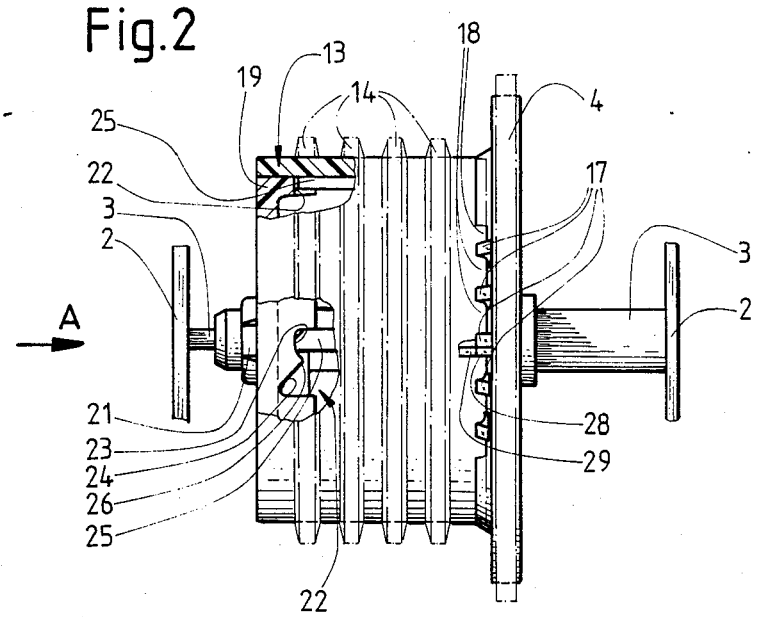
FIG. 2 is a partly broken-away illustration of bell drum and toothed wheel.
Figure 3:
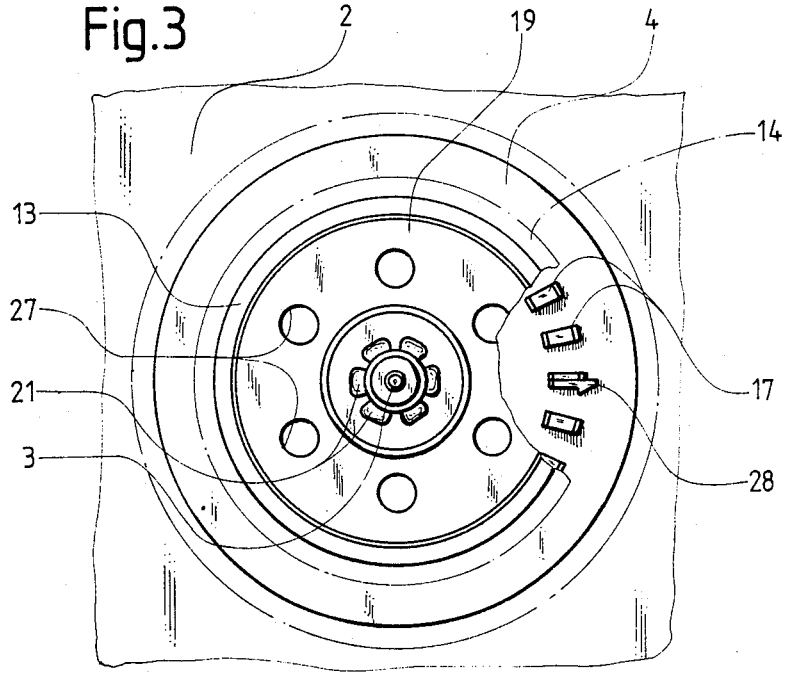
FIG. 3 is a view in the direction of arrow A in FIG. 2.

To enable synchronization of the rhythmic beat audibly emitted by pendulum 8 with the striking of bell 16, it is necessary to correspondingly adjust bell drum 13 with its cams 14 relative to toothed wheel 4. A configuration of toothed wheel 4 and bell drum 13 serving this purpose is illustrated in FIGS. 2 and 3. The toothed wheel 4 which is preferably made of plastic is fixedly arranged on the toothed wheel shaft 3 for rotation therewith. The toothed wheel shaft 3 is mounted for rotation on frame 2. On the face of toothed wheel 4 facing bell drum 13, projections 17 protrude in the axial direction at equidistant angular spacings in the form of a toothing. On the end face of bell drum 13 opposite these projections, axially protruding projections 18 are provided at corresponding angular spacings, likewise in the form of a toothing, and, in the operational state of the metronome illustrated in FIG. 2, positively engage the spaces between the projections 17 on toothed wheel 4. In this way, the toothed wheel is fixedly connected with bell drum 13 for rotation therewith.

Spaced at approximately the axial length of bell drum 13, opposite projections 17 on toothed wheel 4, in a rotatably, but axially immovable manner on shaft 3 is a circular locking disk 19 having such external diameter dimensions that it fits snugly with its external circumference into the likewise circular inner face formed by bell drum 13, thereby imparting support and axial guidance to drum 13. The locking disk 19 which is, for example, likewise made of plastic is secured, in the illustrated embodiment, by claws 21 formed integrally on disk 19 and resiliently engaging a corresponding notch in toothed wheel shaft 3. Hence axial immovability but at the same time rotatability of locking disk 19 relative to shaft 3 is ensured. The locking disk 19 has slight inherent elasticity. It comprises at angular spacings of 90 degrees a total of four axially extending locking recesses 22 located in the interior of bell drum 13 and, in turn, comprised of two regions 23, 24 of different depth. Region 23—viewed in the axial direction—is less deep than region 24. Axially extending, radially inwardly oriented locking tongues 25 which are likewise formed at angular spacings of 90 degrees on the inside of bell drum 13 cooperate with these locking recesses 22. In the operational state illustrated in FIG. 2, locking tongues 25 engage at their ends facing locking disk 19 the shallower regions 23 of locking recesses 22. The bell drum 13 is thereby fixed relative to locking disk 19 and to toothed wheel 4 in such a way that the toothings on toothed wheel 4 and bell drum 13 formed by projections 17, 18 are in mutual engagement and hence toothed wheel 4 and bell drum 13 are in positive connection with each other.

When the locking tongues 25 are transferred from the flat region 23 into the deeper region 24 of the locking recesses 22 by relative rotation of locking disk 19 in relation to bell drum 13, a certain axial play existing within region 24 with respect to locking tongue 25 permits axial displacement of bell drum 13 relative to toothed wheel 4, thereby enabling disengagement of projections 18 from projections 17 and rotation of bell drum 13 relative to toothed wheel 4. As is apparent from FIG. 2, a protuberance 26 between regions 23, 24 of locking recesses 22 must be overcome by the respective locking tongue 25 during relative rotation between locking disk 19 and bell drum 13. This is possible because the elastic locking disk 19 yields somewhat as locking tongues 25 slide over protuberance 26. Hence engagement of locking tongues 25 in regions 23 of recesses 22 is a kind of detent or snap-in closure between locking disk 19 and bell drum 13.

When the positive connection between toothed wheel and bell drum 13 (similarly made of plastic) is released in the above-described manner, the bell drum can be adjusted relative to the toothed wheel 4 for the purpose of synchronization of the rhythmic beat with the stroke of the bell. By subsequent turning of locking disk 19 relative to bell drum 13, the above-mentioned detent connection is established again, whereby toothed wheel 4 and bell drum 13 are fixedly connected again for rotation with each other in a new relative position.

On account of the toothings provided on toothed wheel 4 and bell drum 13 by projections 17, 18, these two parts are no longer infinitely variably adjustable relative to each other, but merely stepwise in accordance with the pitch spacings of the toothings. Hence the synchronization in question can be carried out accurately since in the event of a phase displacement between the rhythmic beat and the stroke of the bell, it is easy to indicate the specific number of pitch spacings through which bell drum 13 must be adjusted relative to toothed wheel 4.

To transfer locking tongue 25 from region 23 into region 24 of locking recess 22, which requires a certain force on account of the elastic snap-in connection, the free front face of locking disk 19 comprises apertures 27 into which a matching tool, for example, a kind of open-end wrench can be inserted and by means of which locking disk 19 can then be turned relative to bell drum 13 to transfer locking tongues 25 from the flat regions 23 into the deeper regions 24 of the locking recesses 22, which, in turn, then enable the necessary axial displacement of the bell drum 13 relative to the toothed wheel 4.

In the illustrated embodiment, four locking recesses 22 and four locking tongues 25 are provided at corresponding angular spacings of 90 degrees. In principle, arrangement of one single locking recess 22 with an associated single locking tongue 25 is sufficient.

Furthermore, in the depicted embodiment, the toothed wheel 4 is axially immovably arranged on the toothed wheel shaft 3 while the bell drum 13 is axially displaceable in relation to the toothed wheel 4. A reverse design wherein the bell drum 13 is fixedly arranged on the toothed wheel shaft 3 and the toothed wheel is axially displaceable is, however, also possible.

One of the projections 17, designated by reference numeral 28 in FIG. 2, is specifically designed or marked to enable the toothed wheel 4 and the bell drum 3 to be brought into a defined normal or initial position during final assembly of the metronome. In the same way, one of the projections 18 is specially designed or marked. In FIG. 2, this is indicated by reference numeral 29. During final assembly, toothed wheel 4 and bell drum 13 are connected in such a way that the two projections 28, 29 are opposite each other, thereby providing a defined initial position for a possible later adjustment.

Figure 4:
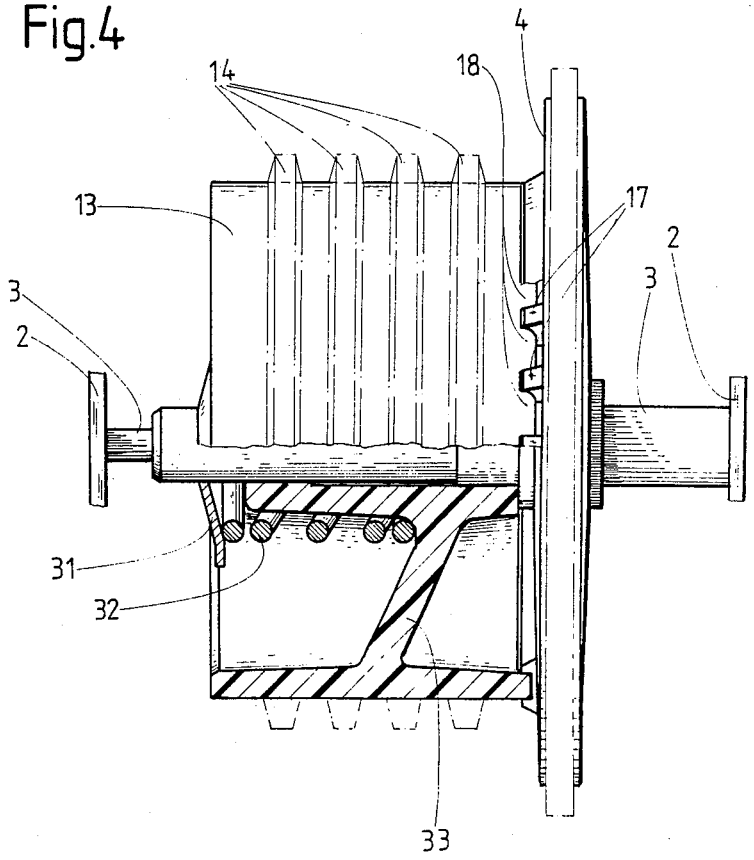
FIG. 4 is a partly broken-away illustration of a modified embodiment.

In the modified embodiment shown in FIG. 4, the securing or holding means between the toothed wheel 4 and the bell drum 13 are of different design. Arranged in an axially immovable manner on toothed wheel shaft 3 is a disk 31 against which one end of a compression spring 32 arranged in the interior of bell drum 13 is supported. The other end of spring 32 engages a ring web 33 in the interior of the drum 13. Thus the compression spring 32 attempts to maintain projections 17, 18 on toothed wheel 4 and bell drum 13, respectively, in mutual positive engagement. To release this engagement, bell drum 13 must be pushed away from toothed wheel 4 in the axial direction against the action of spring 32, for example, by hand. After the necessary angular adjustment between toothed wheel 4 and bell drum 13 has been made, spring 32 brings the two parts into mutual positive engagement again.

What is claimed is:

1. A metronome comprising:

a pendulum which is fixedly mounted on a pendulum shaft for rotation therewith, a toothed wheel shaft which is driven by a windable spring mechanism, a toothed wheel which is fixedly arranged on said toothed wheel shaft for rotation therewith and drives said pendulum by means of an anchor which is fixedly mounted on said pendulum shaft for rotation therewith, a bell which is struck by a bell striker, and a bell drum which is rotatably mounted on said toothed wheel shaft and is normally fixedly connected to said toothed wheel for rotation therewith, to actuate said bell striker, characterized by the following features:

a. said toothed wheel and said bell drum each comprise toothings facing each other, by means of which said toothed wheel and said bell drum are in positive engagement with each other in defined angular positions;

b. said toothed wheel and said bell drum are axially displaceable relative to each other on said toothed wheel shaft in order to release their mutual positive engagement and to alter their angular position;

c. said toothed wheel and said bell drum are kept in mutual positive engagement by releasable holding means.

2. A metronome as defined in claim 1, characterized in that:

said toothed wheel is fixedly arranged and said bell drum is axially displaceably arranged on said toothed wheel shaft.

3. A metronome as defined in claim 1, characterized in that:

said holding means comprise a spring which presses said bell drum against said toothed wheel.

4. A metronome as defined in claim 1, characterized in that:

projections protrude in the axial direction at equidistant angular spacings on the face of said toothed wheel facing said bell drum, and at least one axially protruding projection is provided on the opposite end face of said bell drum for positive engagement in spaces between said projections of said toothed wheel.

5. A metronome as defined in claim 1, characterized in that:

said releasable holding means comprises an elastic locking disk with at least one axially oriented locking recess is arranged in a rotatable, but axially immovable manner on said toothed wheel shaft, and said bell drum comprises at least one axially extending locking tongue which upon mutual rotation of locking disk and bell drum interlocks with said locking recess in such a way that said projections on toothed wheel and bell drum are in mutual engagement.

6. A metronome as defined in claim 2, characterized in that:

said holding means comprise a spring which presses said bell drum against said toothed wheel.

7. A metronome as defined in claim 2, characterized in that:

projections protrude in the axial direction at equidistant angular spacings on the face of said toothed wheel facing said bell drum, and at least one axially protruding projection is provided on the opposite end face of said bell drum for positive engagement in spaces between said projections of said toothed wheel.

8. A metronome as defined in claim 2, characterized in that:

said releasable holding means comprises an elastic locking disk with at least one axially oriented locking recess is arranged in a rotatable, but axially immovable manner on said toothed wheel shaft, and said bell drum comprises at least one axially extending locking tongue which upon mutual rotation of locking disk and bell drum interlocks with said locking recess in such a way that said projections on toothed wheel and bell drum are in mutual engagement.

9. A metronome as defined in claim 4, characterized in that:

said releasable holding means comprises an elastic locking disk with at least one axially oriented locking recess is arranged in a rotatable, but axially immovable manner on said toothed wheel shaft, and said bell drum comprises at least one axially extending locking tongue which upon mutual rotation of locking disk and bell drum interlocks with said locking recess in such a way that said projections on toothed wheel and bell drum are in mutual engagement.

* * * * *